US007413531B2

(12) United States Patent
McLaughlin

(10) Patent No.: US 7,413,531 B2
(45) Date of Patent: Aug. 19, 2008

(54) WHEEL RESISTANCE EXERCISE DEVICE

(76) Inventor: Gary McLaughlin, 13300 Wingo St., Arleta, CA (US) 91331

( * ) Notice: Subject to any disclaimer, the term of this patent is extended or adjusted under 35 U.S.C. 154(b) by 810 days.

(21) Appl. No.: 10/868,540

(22) Filed: Jun. 15, 2004

(65) Prior Publication Data

US 2004/0248700 A1 Dec. 9, 2004

Related U.S. Application Data

(63) Continuation of application No. 09/971,178, filed on Oct. 4, 2001, now Pat. No. 6,749,543.

(51) Int. Cl.
*A63B 22/06* (2006.01)

(52) U.S. Cl. ..... 482/65; 482/74; 482/115; 280/87.021

(58) Field of Classification Search ..... 482/51, 482/57, 65, 66–68, 74, 93, 114, 115, 116, 482/118, 119, 121, 128; 135/67, 85; 280/87.021
See application file for complete search history.

(56) References Cited

U.S. PATENT DOCUMENTS

| | | | | | |
|---|---|---|---|---|---|
| 3,192,772 | A * | 7/1965 | Tarter | 73/379.07 |
| 3,309,084 | A * | 3/1967 | Simmons | 482/62 |
| 3,724,844 | A * | 4/1973 | Olmstead et al. | 482/61 |
| 4,206,914 | A * | 6/1980 | Lee | 482/65 |
| 4,322,070 | A * | 3/1982 | Jordaan | 482/61 |
| 4,364,557 | A * | 12/1982 | Serati | 482/65 |
| 4,423,863 | A * | 1/1984 | Figueroa | 482/62 |
| 4,463,945 | A * | 8/1984 | Spector | 482/62 |
| 4,521,010 | A * | 6/1985 | Hahn | 482/65 |
| 4,572,502 | A * | 2/1986 | Messineo | 482/61 |
| 5,810,697 | A * | 9/1998 | Joiner | 482/68 |
| 6,749,543 | B2 * | 6/2004 | McLaughlin | 482/57 |

* cited by examiner

*Primary Examiner*—LoAn H. Thanh
*Assistant Examiner*—Tam Nguyen
(74) *Attorney, Agent, or Firm*—Lawrence S. Cohen

(57) ABSTRACT

An exercise apparatus that can be attached to any wheeled device that is pushed in which the wheel of the wheeled device is subjected to rolling resistance so that the person pushing it had to push harder thereby experiencing exercise.

7 Claims, 8 Drawing Sheets

WHEEL RESISTANCE EXERCISE DEVICE

RELATED APPLICATIONS AND PATENTS

This application is a continuation in part of application Ser. No. 09/971,178 filed on Oct. 4, 2001 now U.S. Pat. No. 6,749,543 the content of which is incorporated by reference herein

FIELD OF THE INVENTION

The invention relates to wheeled exercise devices.

BACKGROUND

There are various wheel resistance devices, known as stationary bicycles, for exercise in which the user sits on the device and operates pedals against a resistance mechanism.

There are also resistance devices, which allow the user to walk or run while pushing the device and which use various means to impose load or resistance to increase the effort required to push or pull the device.

DETAILED DESCRIPTION

Figure 1:
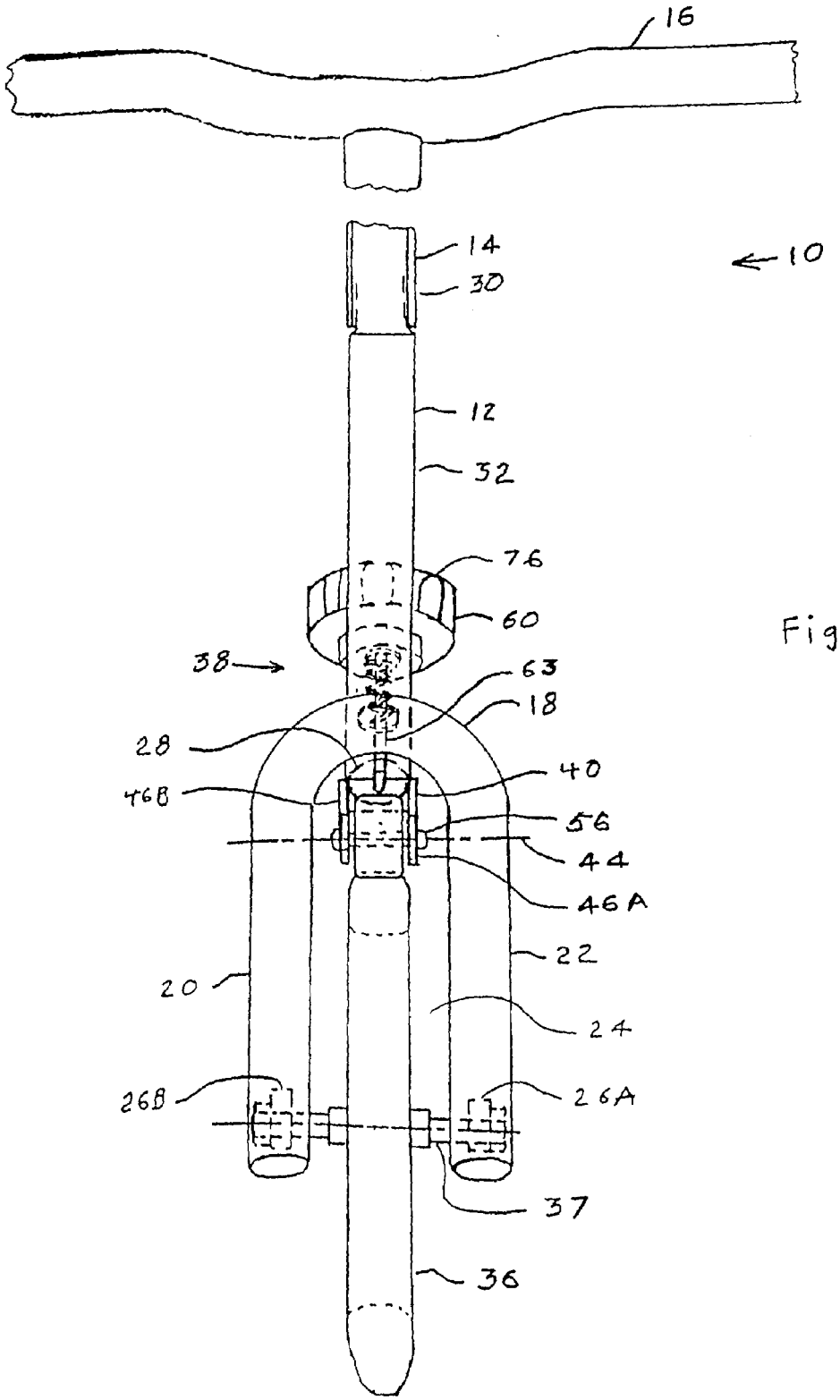
FIG. 1 is a front view of the invention.
Figure 2:
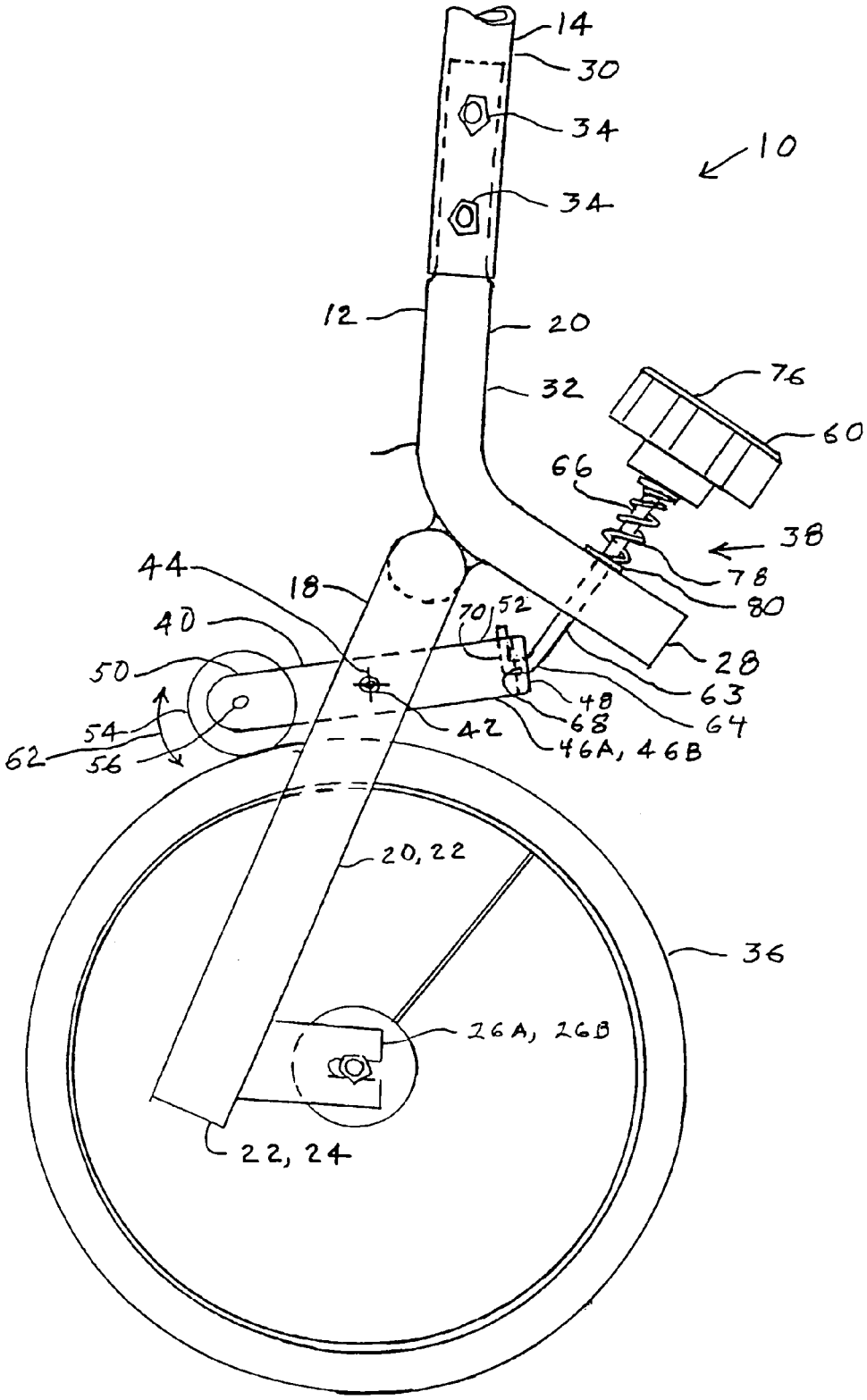
FIG. 2 is a partial side view of the invention.

Referring to FIGS. 1 and 2, the exercise device 10 has a frame 12 consisting of a frame haft 14, at the top of which is a handle bar 16, and having attached at its bottom a wheel fork 18, having wheel fork legs 20 and 22, defining between them a wheel space 24, and terminating in wheel supports 26A and 26B. The frame 12 has a tube extension portion 28. In this particular embodiment, the frame 12 consists of an upper frame shaft portion 30, and a lower frame shaft portion 32, which are joined together by bolts 34. A wheel and tire assembly 36 is located in the wheel space 24 and is rotatably attached to the wheel supports 26A and 26B by an axle assembly 37. This entire structure is similar to the assembly structure of a common bicycle frame front portion, handle bars, forks and wheels. The wheel assembly of a bicycle can be used.

The tube extension portion 28 of the frame 12 is adapted to hold an adjustable resistance assembly 38, which is designed to cause a resistance wheel to bear on the wheel and tire assembly 36 and is adjustable to increase or decrease the bearing pressure on the wheel and tire assembly 36.

In the preferred embodiment of the resistance assembly 38, a lever 40 is pivotally attached between the wheel fork legs 20 and 22 by a pin or bolt 42, which defines a pivot axis 44 for the lever 40. In this embodiment the lever 40 is formed by a pair of spaced-apart opposed arms 46A and 46B connected by a brace 48. The lever 40 has a first end 50, which is forward of the pivot axis 44, and a second end 52, which is rearward of the pivot point. Attached to the first end 50 of the lever 40 is a small resistance wheel 54 rotatable on a bearing pin 56 mounted through the opposed arms 46A, 46B.

Attached at the second end 52 as part of the adjustable resistance assembly is an adjusting mechanism 60, which adjustably pivots the lever 40 on the pivot axis 44 to cause the resistance wheel 54 to pivot as shown by arrow 62.

The adjusting mechanism 60 has an adjusting link 63 having a lower end 64 and an upper end 66. The lower end 64 enters the hole 68 in the brace 48 and is bent upward at 70 to be fixed in place. The upper end 66 is threaded (not shown). The adjusting link 63 passes through the tube extension portion 28 and has a threaded knob 76 threaded onto the threads at the upper end 66. A spring 78 is fitted between the threaded knob 76 and the tube extension portion 28 and is constructed so as to be in a compressed condition for most of the useful travel of the knob 76 so as to keep the knob 76 from turning by itself. A washer 80 is helpful.

Figure 3:
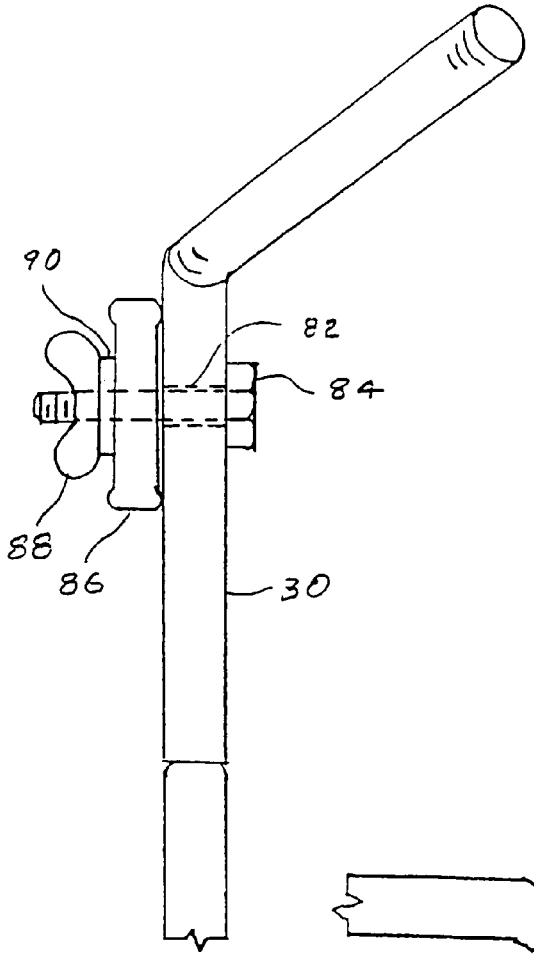
FIG. 3 is a partial side view showing a feature of the invention.
Figure 4:
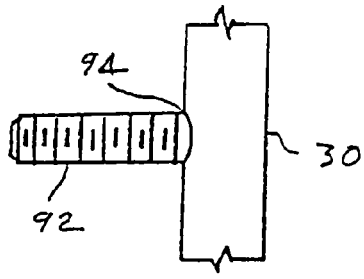
FIG. 4 is a side view of a detail of the invention.
Figure 5:
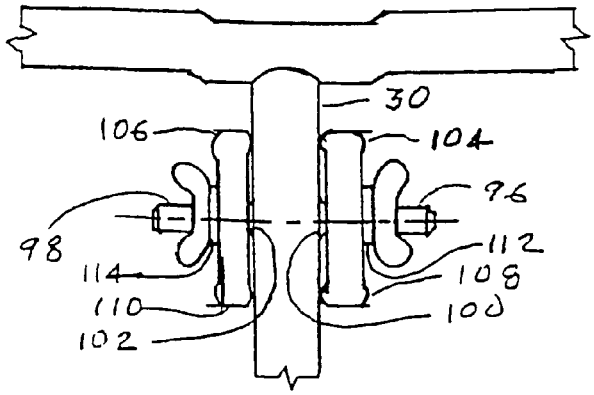
FIG. 5 is a partial side view showing a feature of the invention.

An additional exercise variable can be obtained by providing means to attach free weights to the device. One means for doing this is shown in FIG. 3. As shown, the upper frame shaft portion 30 has a hole 82 extending through it. A bolt 84 is in place through the hole and a weight 86 is mounted on the bolt 84. In this example, the weight 86 is retained by a wing nut 88 threaded onto the bolt 84 along with a washer 90. FIG. 4 shows another means for mounting a weight in which a threaded rod 92 is welded to the shaft 30 at 94. In another embodiment a clamp device could be configured with a rod or bolt attached, in which the position of the clamp can be adjusted, up or down on the shaft. Other forms could include all of the above means in which a pin or bolt extends sideways of the shaft, to each side, allowing a weight to be mounted on each side of the shaft. An example of this is shown in FIG. 5 in which the shaft 30 has rods 96, 98 extending oppositely to each side. The rods 96, 98 can be welded as at 100, 102 to the shaft 30. In this configuration, weights 104, 106 can be oppositely mounted on the respective rods 100, 102, held by wing nuts 108, 110 and washers 112, 114.

In use, the upper shaft portion 30 is assembled to the lower shaft portion 32. The knob 76 is adjusted to pivot the lever 40 to cause the resistance wheel 54 to bear on the tire 36 to a pressure as desired. Greater pressure will cause more resistance to turning of the tire 36. To obtain exercise the user takes a position behind the device after adjusting the knob 76 to create the desired resistance. Then the user pushes the handlebars ahead of himself or herself to cause the tire 36 to turn. The tire 36 will turn with greater or lesser required pushing force depending on the setting of the knob 76.

If the knob 76 is set so that resistance wheel 54 provides little or no resistance to turning of tire 36, then the device can be pushed easily ahead of the user. But, as more resistance is placed on tire 36, more effort will be required to push the device. In general, as the required force increases, more effort will be required to push the device. In general, as the required force increases the user will tilt the frame 12 to angle the tire 36 further away, but preferably not more than 45°.

Also, to change the muscles exercised, the shaft 14 may be tilted less and its user uses his or her arms to push downward on the shaft 14 to overcome the resistance, preventing the tire 36 from skidding.

Of course "cheating" by letting its tire 36 skid along the ground is self-defeating. If this happens, either greater downward pressure is exerted, or a sharper angle is created, or both.

The resistance can be adjusted according to a set plan such as, less resistance for warm-up or aerobic exercise and more resistance for muscle building such as by pushing through the legs and arms.

Other embodiments of the invention is shown in FIGS. 6, 7, 8, 9, and 10.

In those other embodiments the invention is a portable and transferable wheel resistance apparatus that can be installed on various wheeled devices and removed when no longer desired or when it desired to use it on a different wheeled device. It can be used on existing devices such as a baby carriage; or it can be used on a device especially built for it. The portable and transferable wheel resistance device has as adjustment mechanism that retards the rotation of the road wheel of the wheeled device on which it is installed and can be adjusted to increase the retarding force or to decrease the retarding force, also called resistance. This makes the wheeled device adjustably more or less resistant to being pushed and that resistance gives exercise to the user. The exercise resistance apparatus resides in two forms. In one form a friction member is in direct contact with the road wheel of the wheeled device on which the apparatus is mounted. In the other form an intermediate resistance wheel is in rotational contact with the road wheel of the device and a friction member is in contact with the intermediate resistance wheel. In both forms, the exercise apparatus is mountable onto and dismountable from the wheeled device and it may be adjusted in its position on the wheeled device for best use, and it may be removed.

Figure 6:
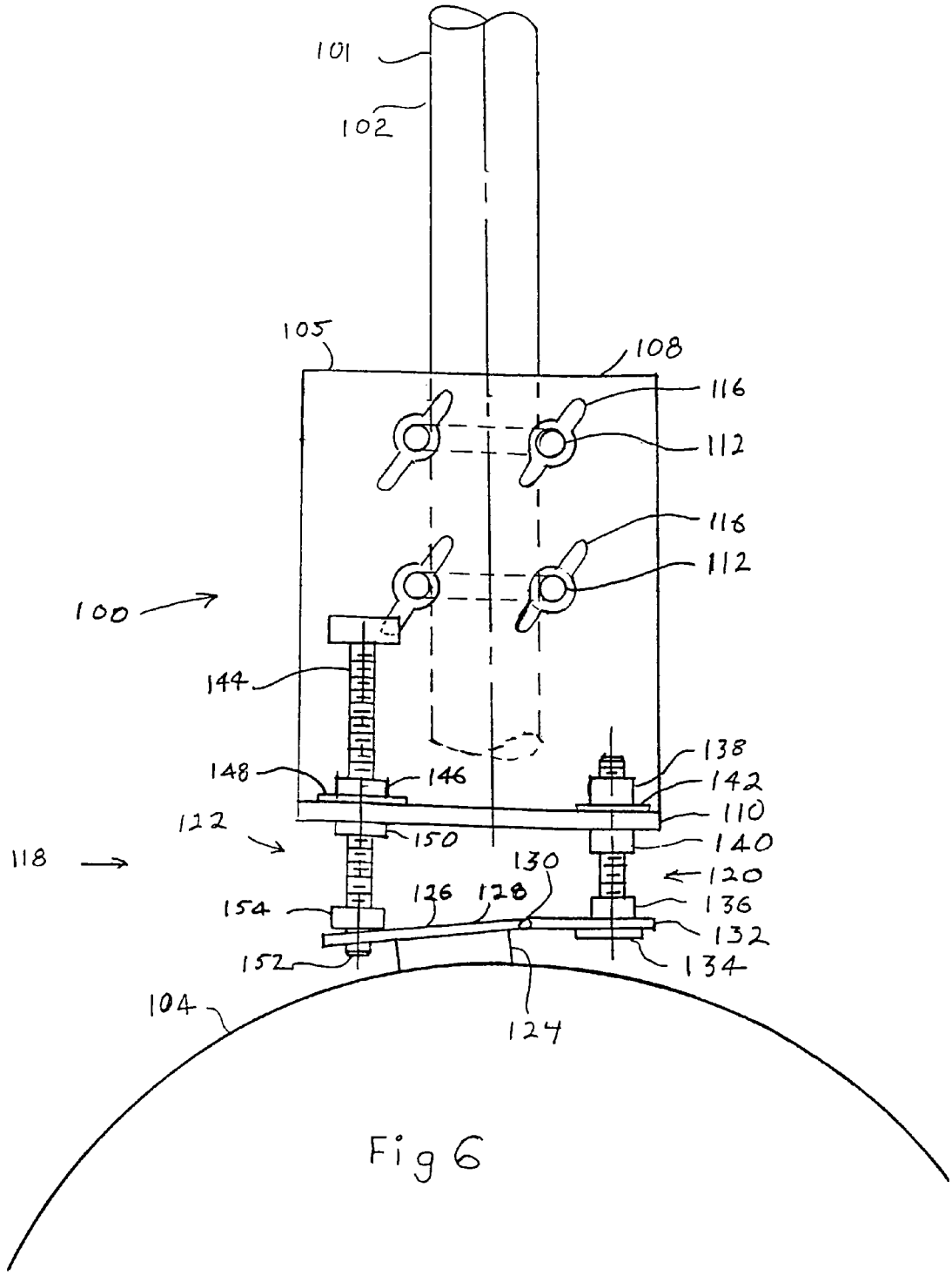
FIG. 6 is a view of an alternative embodiment.
Figure 7:
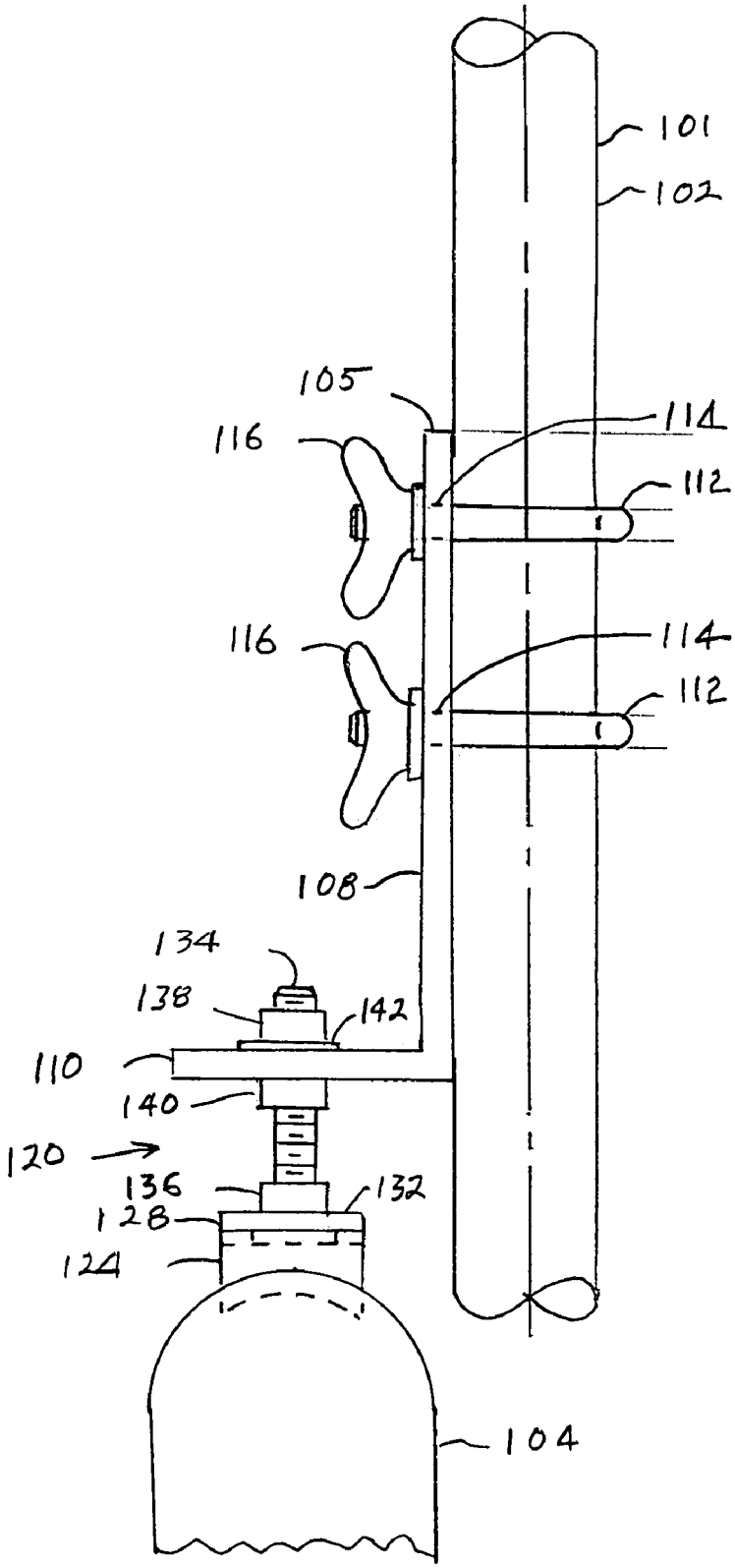
FIG. 7 is another view of the embodiment of FIG. 6.

Referring to FIGS. 6 and 7 there is shown the exercise apparatus 100 (partial in FIG. 7) attached to a wheeled device 101 partially illustrated by the rod or post 102 and the road wheel 104. The exercise apparatus 100 has a bracket 105 that has an attachment portion in the exemplary form of a vertical plate 108 and a drag assembly support portion in the form of a horizontal plate 110 that extends at a right angle from the bottom of the vertical plate 108 in a direction opposite to the placement of the rod or post 102. The horizontal plate 108 is attached to and is readily removable from the rod or post 102 by U-bolts 112 that are aligned vertically to capture in their bight the rod or post 102. The U-bolts 112 extend through holes 114 in the vertical plate 108 and are fixed by nuts such as the easily operated wing nuts 116.

The drag assembly 118 that is attached to and extends downwardly from the horizontal plate 108 has two portions, the friction assembly 120 and the adjustment assembly 122.

The friction assembly 120 has a friction member 124 that is on a movable side 126 of a hinge 128 so that it can pivot up and down on the hinge pivot 130. The friction member 124 may be made of any suitable material that can engage the road wheel to create the resistance, metal, rubber and plastic are possible materials. The other side of the hinge, the immovable side 132 is mounted on the horizontal plate 110 by a bolt 134, held tight by a nut 136. The bolt 134 is attached to the horizontal plate 110 by nuts 138 and 140 and a washer 142.

The adjustment assembly 122 also extends downwardly from the horizontal plate 110 and is laterally spaced from the friction assembly 120. It has a bolt 144 that is fixed to the horizontal plate 108 by a nut 146 and a washer 148 on top (instead, the nut 146 may be welded to the horizontal plate 110) and a nut 150 on the bottom. Alternatively the horizontal plate 108 could be threaded and a lock nut applied on the top or bottom of the horizontal plate 108. The lower end 152 of the bolt 144 extends through an opening (not shown) in the movable side 126 of the hinge 128, although it could simple bear on the movable side 126 of the hinge 128. A nut 154 at the lower end 152 allows for fine adjustment although it could be welded onto the bolt 144, with all adjustment being made by rotation of the bolt 144.

In use the exercise apparatus 100 is fitted to the rod or post 102 with the hinge rotated upwardly to the most upward position of the movable side 126, contemplating the amount of wear that might be expected. It is then fixed in place by tightening the U-bolts 112. Then the adjustment assembly 122 is adjusted to push the friction member 124 down on the road wheel 104. Some trials are tried until the desired resistance to pushing the device 101 is found. Also as the friction member 124 wears smaller adjustments to the adjustment assembly can compensate, although generally it is also anticipated that adjustment for wear will be accomplished by lowering the exercise device 100 on the rod or post 102. If the resistance to pushing the wheeled device 101 is too much the adjustment assembly 122 can be backed off by unscrewing the bolt 144, or if more resistance is wanted by screwing it down.

Figure 8:
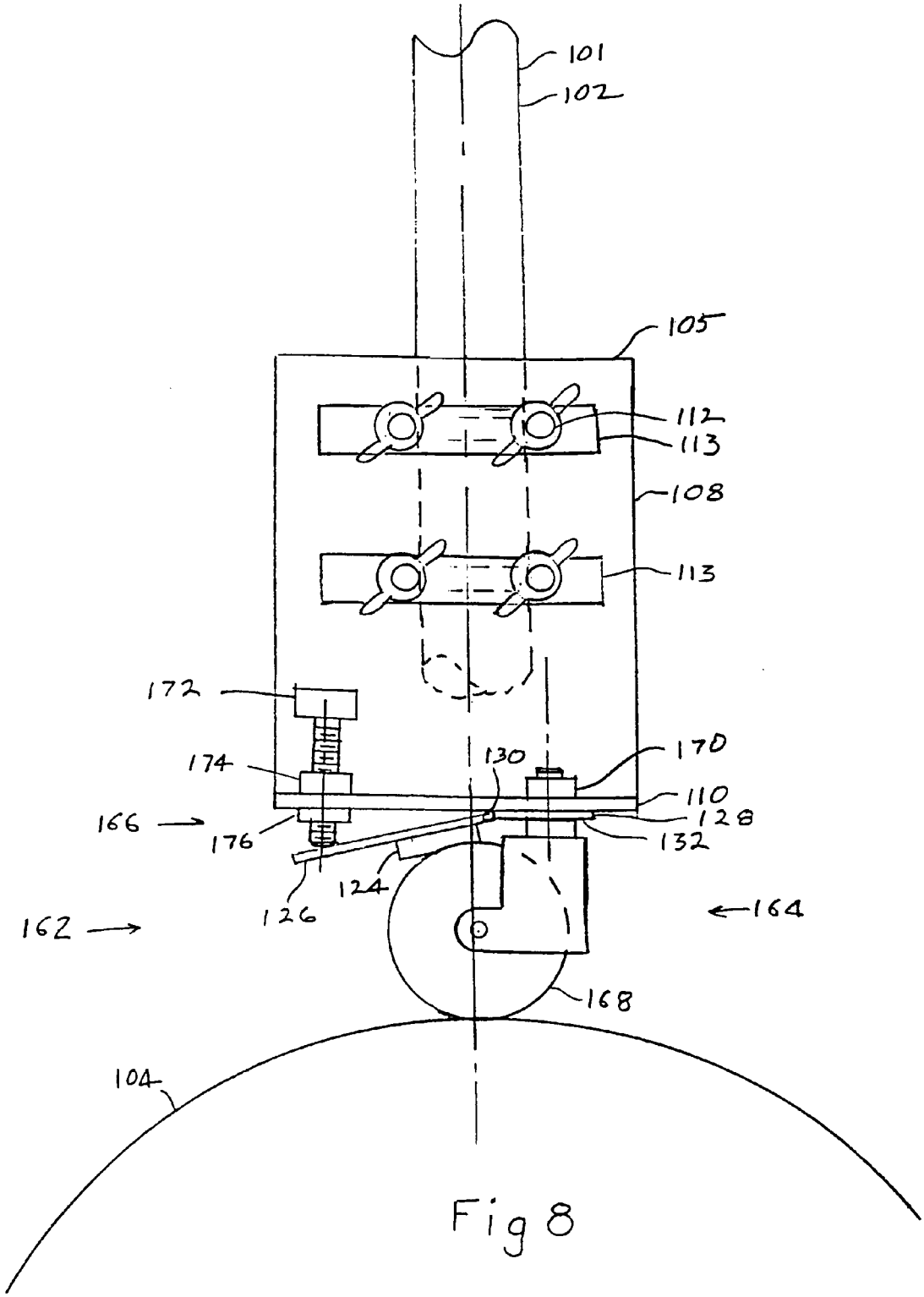
FIG. 8 is a view of another embodiment.

An alternative embodiment of the exercise device 160 is shown in FIG. 8. The side view can be appreciated by FIG. 7 which is similar. In this embodiment the attachment portion and operation is as described above with respect to FIGS. 6 and 7. It differs in the drag assembly 162 which also has two portions, the friction assembly 164 and the adjustment assembly 166. The friction assembly 164 has a resistance wheel 168 attached to and extending below the horizontal plate 110. It is attached by nut 170 and 171. On the shaft of the resistance wheel 168 is the immovable side 132 of the hinge 128. The movable side 126 of the hinge 128 extends laterally and is pivotable on the hinge pivot 130. On the movable side 126 is the friction member 124 that contacts the resistance wheel 168. The far end of the movable side 126 is pressed by a bolt 172 that is adjustable on the horizontal plate 110 by means of nuts 174 and 176. The very same construction for the adjustment bolt as shown in FIG. 6 could be used here, but this alternative construction is shown. In this form it assumed that the resistance wheel 168 will not wear appreciably; so it is not contemplated that adjustment of the exercise apparatus on the rod or post 102 will be needed after it has been satisfactorily placed.

In use the embodiment of FIG. 8 is tightened in place with the U-bolts 112 (backing plates 113 can be used), with the resistance wheel 168 pushed firmly onto the road wheel 104. so that it will not slip. Then the adjustment assembly is operated to get the desired amount of resistance to rotation of the resistance wheel 168 that will accordingly cause the road wheel 104 to resist rotation.

Figure 9:
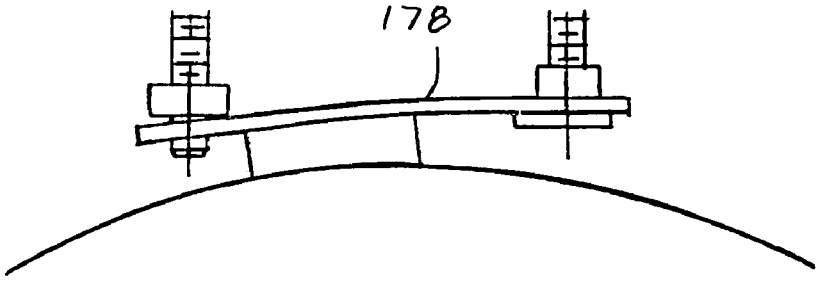
FIG. 9 is a partial view of an alternative embodiment.

FIG. 9 shows an alternative construction that is applicable to both of the foregoing embodiments. In this construction the friction member 124 is on a flexible bar 178 that could also be resiliently biased upwardly or downwardly. Although the partial figure is from the embodiment of FIGS. 6 and 7, the flexible bar 178 could also be fitted to the embodiment of FIG. 8.

As described above the exercise device can be fitted to any wheeled device such as a baby carriage, that is constructed so as to allow it to be fixed in place on a rod or post and that has a road wheel that can be contacted by the friction member or the intermediate wheel.

Figure 10:
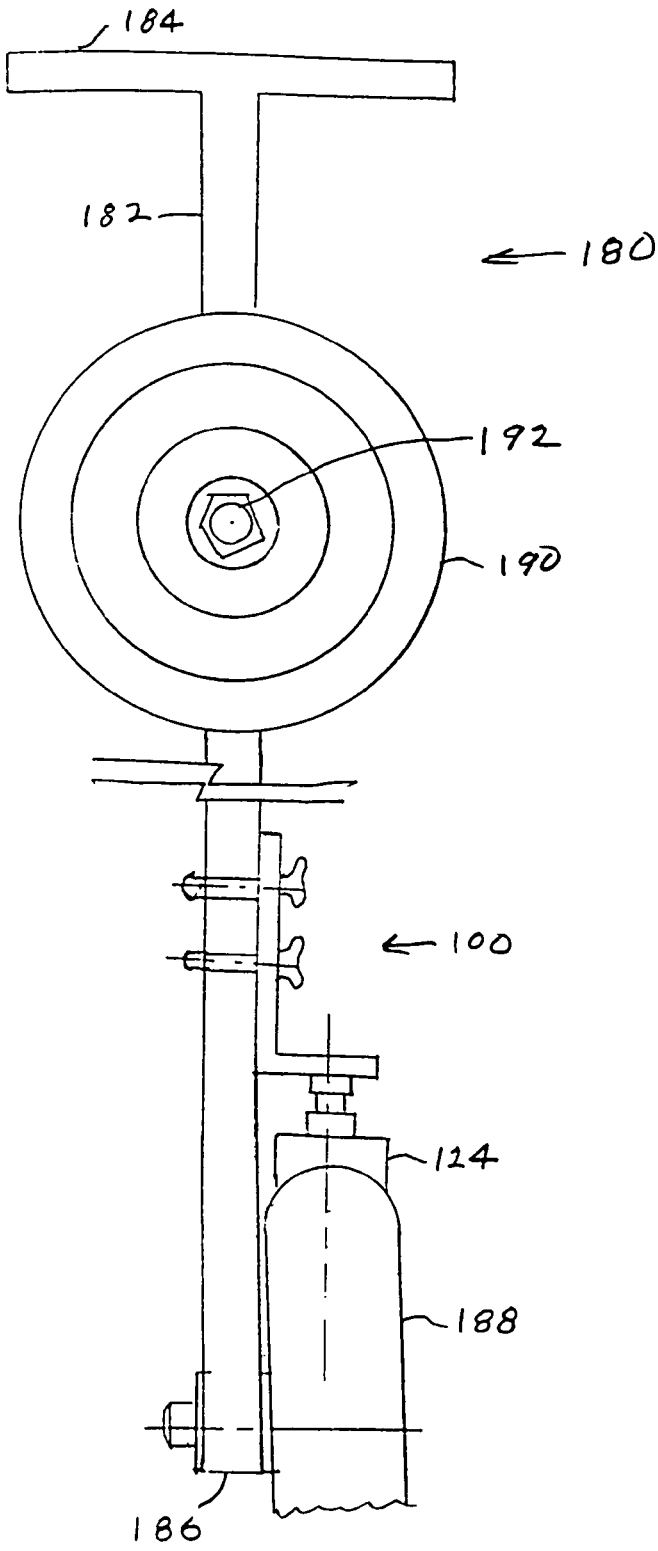
FIG. 10 is a view of another alternative embodiment.

FIG. 10 shows a wheeled device 180 that is specially designed for the exercise apparatus 100 described above. The wheeled device 180 has an elongated post 182 (shown broken in FIG. 10) At the top of the post 182 is handelbar 184. The post 182 terminates at a lower end 186. A road wheel 188 is mounted near the lower end 186. It is mounted in any convenient way to facilitate rolling. Just above the road wheel 188 the exercise apparatus 100 is fitted to the post 182 in the manner described above. This specially designed combination of the exercise apparatus 100 and the wheeled device 180 defines a variable resistance pushing exercise device. In use the frictional engagement of the friction member 124 on the road wheel 188 is set to a desired amount of resistance. The user holds the handelbar 184 and pushes while walking, jogging or running. The angle of the variable resistance pushing exercise device depends on the amount of resistance; although the angle can be adjusted. For example, for added exercise. the device can be held more upright and downward pressure exerted to create sufficient friction of the road wheel on the ground to overcome the resistance set by the friction member. In this way, in addition to pushing exercise, upper body exercise can be accomplished. Additional weight 190 can be carried by a bolt 192.

In all of the embodiments described above the portable exercise apparatus can be fitted to a wheeled device by any convenient means such as by screws or bolts or by welding or by flexible straps.

Although particular embodiments of the invention have been described and illustrated herein, it is recognized that modifications and variations may readily occur to those skilled in the art and consequently it is intended that the claims be interpreted to cover such modifications and equivalents.

The invention claimed is:

1. A variable resistance pushing exercise device comprising;

an elongate post;

a handlebar at an upper end of an elongate post;

a handle bar coupled to an upper end of the elongate post;

a road wheel rotatably coupled to an opposite terminal end of the elongate post; and an exercise apparatus mounted on the elongated post to apply resistance to rotation of the road wheel wherein the exercise apparatus comprises:

a bracket having an attachment portion and a drag assembly support portion;

attachment means connected to the attachment portion for attaching the exercise apparatus to the elongate post proximate to the road wheel;

a drag assembly comprising:

a resistance wheel attached to the drag assembly support portion in contact with the road wheel;

a friction assembly that has a friction member that is movable into more or less forceful contact with the resistance wheel to cause more or less resistance to rotation of the resistance wheel and consequently of the road wheel; and a mechanism for adjusting the force of contact of the friction member with the resistance wheel wherein the road wheel is adapted to be rolled upon the ground by a user during exercise.

2. The exercise device of claim 1 wherein the mechanism for adjusting force comprises an adjustment screw threadedly disposed on the drag assembly support portion in contact with the friction assembly and operative to be turned in one direction to push the friction member into more forceful contact with the resistance wheel and in the opposite direction to decrease the force of contact of the friction member with the road resistance wheel.

3. The exercise device of claim 1 wherein the attachment means is at least two U-bolts vertically aligned and separated to hold the apparatus to a portion of the elongated post.

4. The exercise device of claim 1 in which the friction assembly comprises a support member on which the friction member is attached that is at least in part movable toward and away from the resistance wheel to move the friction member into more or less forceful contact with the resistance wheel and the adjustment mechanism is adjustable in one direction to push the support member toward the resistance wheel to increase pressure of the friction member on the road wheel and is adjustable in the opposite direction to relieve pushing of the support member to decrease pressure of the friction member on the resistance wheel.

5. The exercise device of claim 4 in which the support member is a hinged member one side of which is immovably attached to the drag assembly support portion and the other side of which is pivotably responsive to the adjustment mechanism.

6. The exercise device of claim 4 in which the support member is a flexible member of which one end is immovably attached to the drag assembly support portion and the other end is adjusted by the adjustment member.

7. The exercise device of claim 5 in which the attachment portion of the bracket is a vertical plate and the drag assembly support portion of the bracket is a horizontal plate integral with the vertical plate, and the support member is attached to the horizontal plate and the adjustment mechanism is attached to the horizontal plate both extending below the horizontal plate and the horizontal plate extends from the vertical plate in a direction opposite to the attachment means.

* * * * *